United States Patent [19]

Coleman

[11] Patent Number: 4,471,892

[45] Date of Patent: Sep. 18, 1984

[54] MATERIAL CONTAINER HAVING A FLEXIBLE FOLLOWER

[75] Inventor: Clarence B. Coleman, Oakland, Calif.

[73] Assignee: Fabricated Metals, Inc., San Leandro, Calif.

[21] Appl. No.: 120,629

[22] Filed: Feb. 11, 1980

[51] Int. Cl.[3] ..... G01F 11/00

[52] U.S. Cl. ..... 222/386.5; 220/93; 222/386; 222/478

[58] Field of Search ..... 222/148, 319, 320, 386, 222/386.5, 388–389, 529, 478; 220/93, 221, 222, 226; 15/246.5; 141/27

[56] References Cited

U.S. PATENT DOCUMENTS

| | | | |
|---|---|---|---|
| 252,076 | 1/1882 | Carter | 222/325 |
| 1,905,913 | 4/1933 | Kopp | 222/340 |
| 2,131,498 | 9/1938 | Chandler | 222/340 |
| 2,393,217 | 1/1946 | Brewton | 222/320 |
| 2,652,068 | 9/1953 | Petro | 222/389 |
| 2,660,491 | 11/1953 | Sundholm | 222/386 |
| 2,767,890 | 10/1956 | Carter | 222/386 |
| 3,235,138 | 2/1966 | Bull | 222/340 |
| 3,501,056 | 3/1970 | Mead | 222/386 |
| 3,781,942 | 1/1974 | Coleman | 222/386.5 |

FOREIGN PATENT DOCUMENTS

| | | | |
|---|---|---|---|
| 2309 | 10/1856 | United Kingdom | 222/320 |

*Primary Examiner*—H. Grant Skaggs
*Attorney, Agent, or Firm*—Jack M. Wiseman

[57] ABSTRACT

A material container for bulk material having a follower disposed therein. The diaphragm of the follower is co-extensive with the transverse cross-section of the container. During the removal of bulk material from the container, the follower moves downwardly in constant engagement with the upper surface of the bulk material for wiping the interior surface of the container and for applying a downward force on the bulk material. When bulk material is being discharged into the container for the filling thereof, the follower may be held at the upper portion of the container. A central access opening is formed in the top wall of the container and a central opening is formed through the diaphragm of the follower directed in the axial direction of the container. A tube through which bulk material is conducted into the container for passage below the flexible follower is fixed to the follower in communication with the central opening thereof and is arranged to receive bulk material having passage through the access opening of the container.

15 Claims, 11 Drawing Figures

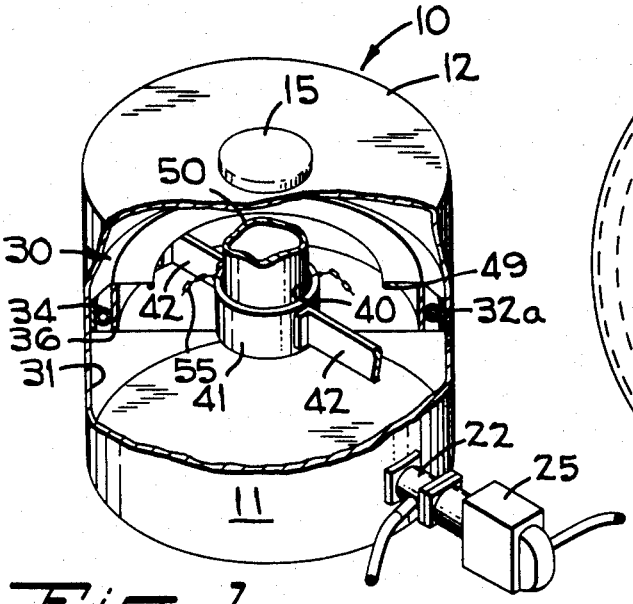
Fig-1
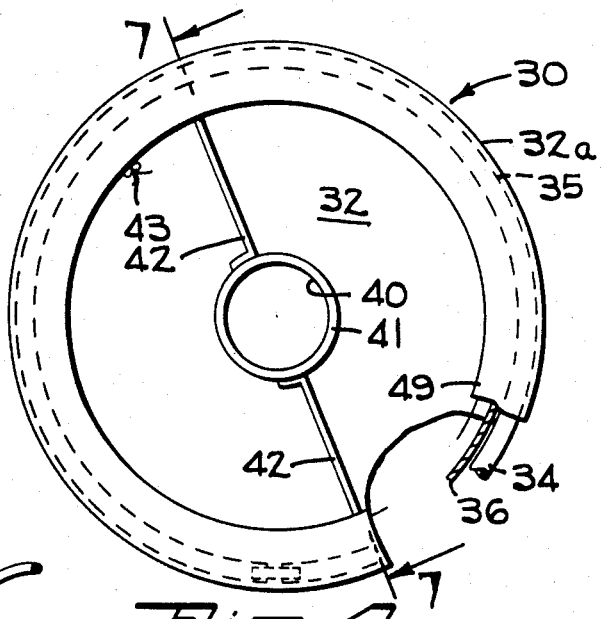
Fig-4
Fig-4A
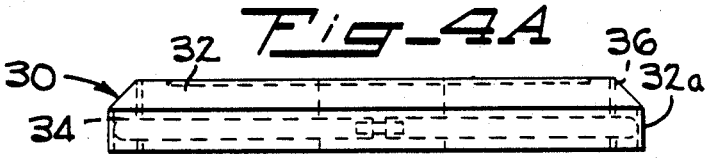
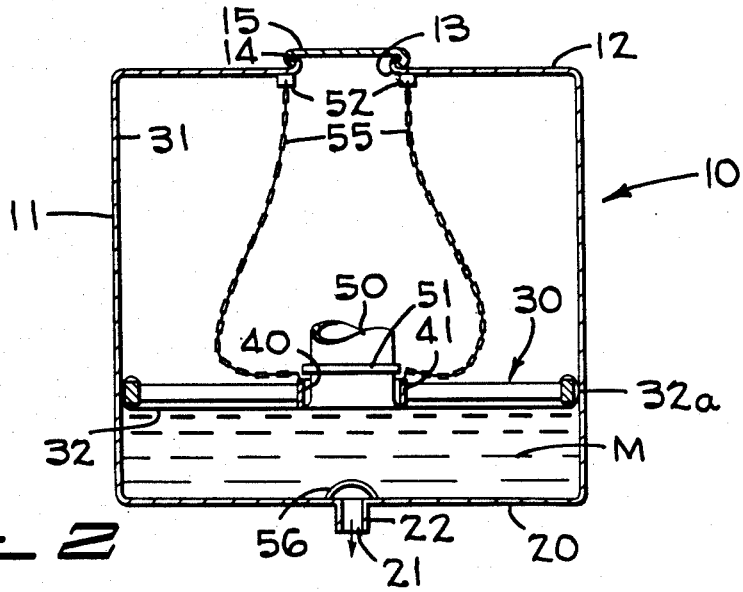
Fig-2
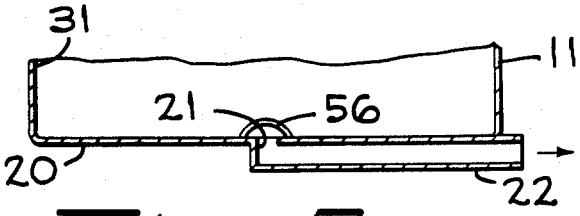
Fig-3

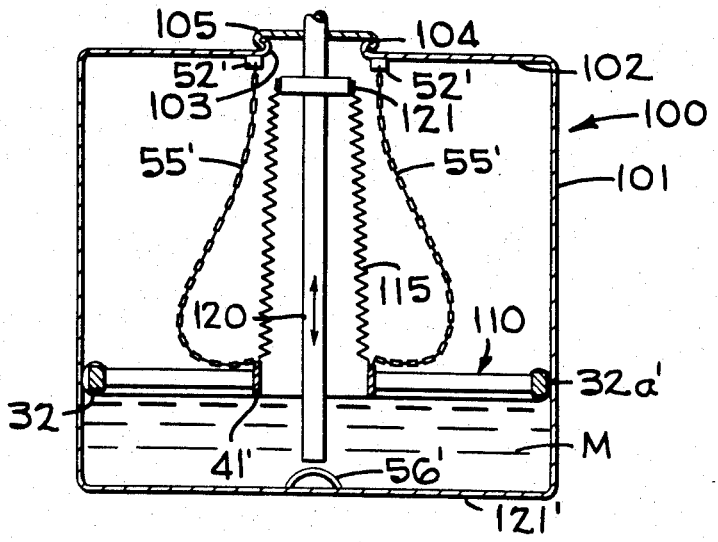
Fig-5
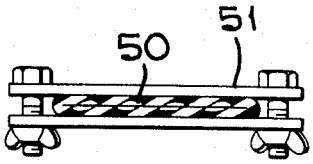
Fig-6
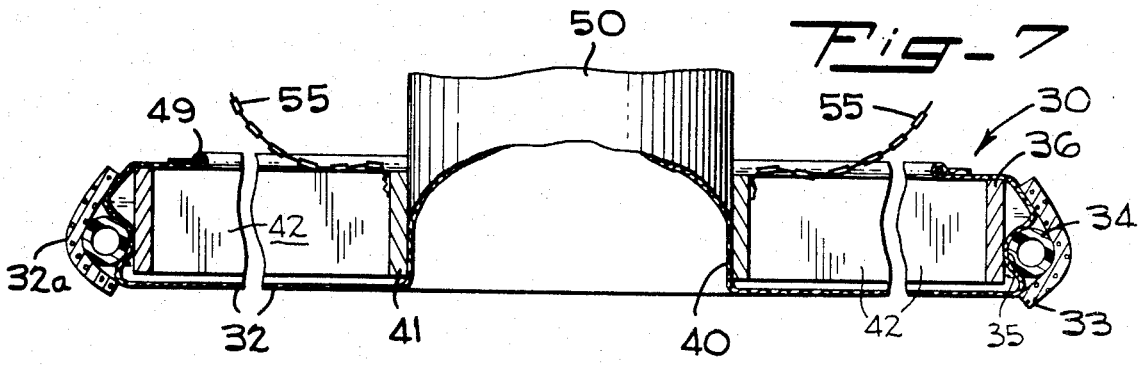
Fig-7
Fig-8
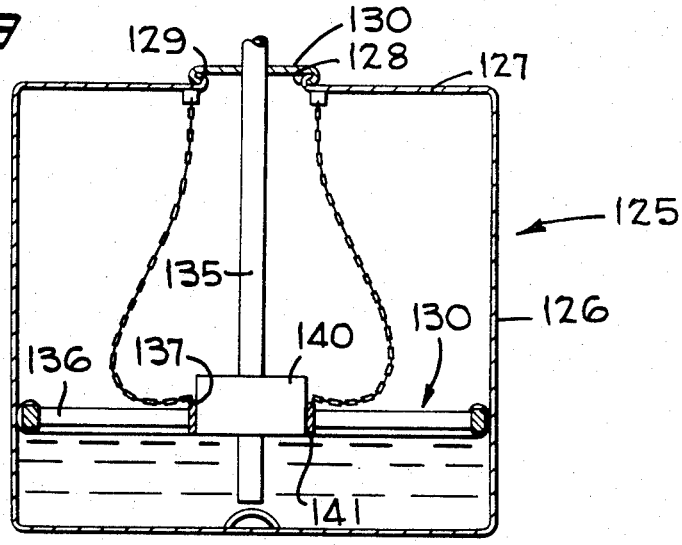

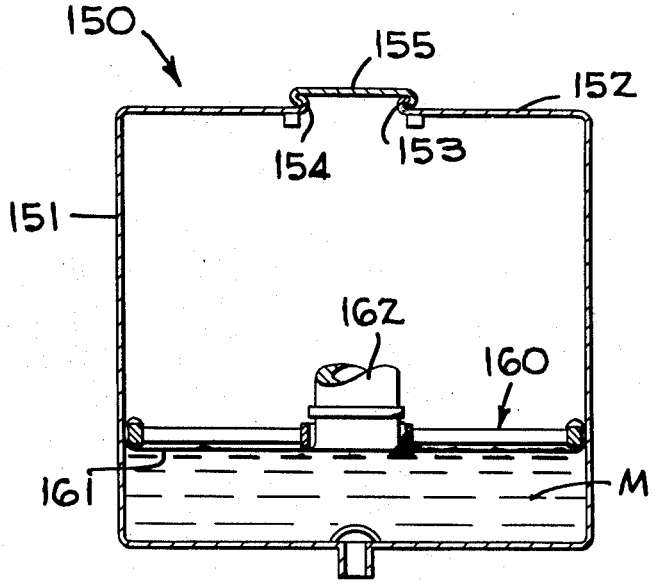
Fig_9
Fig_10
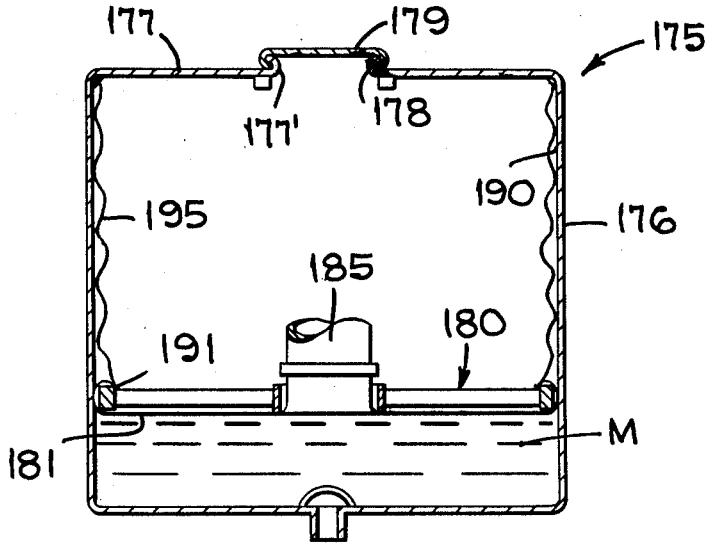

MATERIAL CONTAINER HAVING A FLEXIBLE FOLLOWER

BACKGROUND OF THE INVENTION

The present invention relates in general to containers for bulk material, and more particularly to a container for bulk material having a follower constantly engaging the upper surface of the bulk material as the bulk material is removed from the container.

Heretofore, bulk material containers employed flexible followers for cleaning the interior surfaces of containers for bulk material and for applying a downward force on the bulk material. Such bulk material containers are disclosed in the patent to Coleman, U.S. Pat. No. 3,781,942, issued on Jan. 1, 1974, for Follower For Material Containers.

To fill a material container having a flexible follower, it was the practice to fill the container by discharging viscous or liquid material into the container below the flexible follower and at the axial center of the bottom wall of the container so that the flexible follower would rise, as the viscous material is filling the container, in a horizontal position. More specifically this practice was carried out to maintain the flexible follower in a horizontal plane perpendicular to the cylindrical axis of the container, as distinguished from being tilted or at an acute angle relative to the cylindrical axis of the container.

It has been desirable to fill the container with bulk material by discharging material into the container through the top wall of the container. Previously, the material container had to be either inverted or have the bulk material pumped in under the diaphragm.

In the aforementioned patent to Coleman, U.S. Pat. No. 3,781,942, there is disclosed an arrangement for introducing bulk material through the access opening at the top of the container through an inlet conduit extending near the bottom of the container. The diaphragm of the flexible follower was formed with an opening through which the inlet conduit passed. The opening was shaped so that the walls surrounding the opening received the inlet conduit in a snug manner. The container may be filled in the manner just described and the material may be withdrawn from the container from an outlet opening at the bottom of the container or through a sump pump connection. Additionally, the bulk material may be removed through the access opening.

Heretofore, bulk material containers suitable for viscous material employed a flexible bag liner in which the viscous material was contained while disposed in the material container. A dip tube passed through the top wall of the material container and was disposed in the flexible bag liner for discharging viscous material into the flexible bag liner. Such a bulk material container is disclosed in the patent to Coleman, U.S. Pat. No. 3,590,888, issued on July 6, 1971, for Composite Container And Method Of Handling Fluent Materials.

SUMMARY OF THE INVENTION

A bulk material container comprising a follower having its diaphragm disposed coextensive with the transverse cross-section of the container. An access opening is formed in the top wall of the container. An opening is formed through the diaphragm of the follower directed in the vertical direction of the container. A tube is attached at the lower end thereof to the follower in communication with the opening therethrough and extends upwardly toward the access opening of the container for receiving material having passage through the access opening of the container for filling said container with bulk material.

By virtue of the present invention, a container for bulk material is provided which has the advantages of a follower and can receive material through the access opening in the top wall of the container in an improved manner.

There is a full communication between the central opening of the follower and the access opening of the container to provide a high speed filling operation and yet the fill fitting can be sealed off.

A feature of the present invention is the provision of a tube that has its lower end attached to the follower and extends upwardly toward the access opening of the container for receiving material having passage through the access opening of the container when the follower is held at the upper portion of the container.

Another feature of the present invention is to provide a follower for a bulk material container which has a central opening therethrough for the discharge of bulk material therebelow. The follower is formed with an inner and outer ring interconnected by radially disposed members. Through this arrangement, the follower maintains a flatter shape during the filling of the container so as to provide greater material fill space within the container. More specifically, the follower is structurely supported during the filling operation, when the follower rises in the container, rather than allowing the follower to be unduly yieldable in the axial direction thereof.

Another feature of the present invention is that the central opening through the follower makes it possible for operators to test the contents of the material discharged into the container below the follower during all stages of the filling operation and from any location within the container below the follower.

By providing an inner ring about the central opening found in the follower, the lifting of the follower is made easier.

DESCRIPTION OF THE DRAWINGS

FIG. 1 is an elevation view of a bulk container embodying the present invention with portions thereof broken away to illustrate a flexible follower in the elevated position and a tube for discharging bulk material into the container below the flexible follower for filling the container with bulk material.

FIG. 2 is a vertical section view of the bulk container shown in FIG. 1 taken along the axis thereof with portions thereof shown in elevation to illustrate the flexible follower in a lowered position for discharging bulk material from the container through a bottom wall.

FIG. 3 is a fragmentary vertical section view of the bulk container shown in FIGS. 1 and 2 similar to FIG. 2 but illustrating the discharge of bulk material from a side outlet.

FIG. 4 is a fragmentary plan view of the flexible follower employed in the bulk container shown in FIGS. 1 and 2.

FIG. 4A is an elevation view of the flexible follower shown in FIG. 4.

FIG. 5 is a vertical sectional view of a bulk container which is a modification of the bulk container shown in FIGS. 1 and 2 taken along the axis thereof and illustrated with a dip tube disposed within a flexible tube for discharging bulk material into the container below the flexible follower for filling the container with bulk material, and for removing bulk material from the container.

FIG. 6 is a top view of a clamp for sealing the tube shown in FIGS. 1–4.

FIG. 7 is a vertical section view of the flexible follower taken along line 7—7 of FIG. 4.

FIG. 8 is a vertical sectional view of a bulk container which is a modification of the bulk container shown in FIG. 5 taken along the axis thereof.

FIG. 9 is a vertical sectional view of a bulk container which is a further modification of the bulk container shown in FIGS. 1 and 2 taken along the axis thereof.

FIG. 10 is a vertical sectional view of a bulk container which is a modification of the bulk container shown in FIG. 9 taken along the axis thereof.

DESCRIPTION OF THE PREFERRED EMBODIMENTS

Illustrated in FIGS. 1 and 2 is a bulk material container 10 embodying the present invention which includes a well-known cylindrical rigid shell 11 made of suitable material, such as mild steel, aluminum or stainless steel. Formed in a top wall 12 of the shell 11 is a suitable material inlet or access opening 13. Surrounding the access opening 13 is a suitable flange or lid receiving lip 14. A conventional cover 15 is detachably secured to the flange 14 for sealing the bulk material container 10. Generally, the access opening 13 is of a sufficient size to enable a person to enter and leave the shell 11 for cleaning, inspecting and repairing the interior of the container 10.

At a bottom wall 20 of the shell 11 is an outlet opening 21 through which bulk material may be discharged from the container 10. A suitable conduit 22 is attached to the bottom wall 20 of the shell 11 in communication with the outlet opening 21. A conventional pump or sump 25, in the exemplary embodiment, is connected to the conduit 22 to create a suction for drawing bulk material from the container 10. If desired, the conduit 22 can be disposed axially relative to the axis of the cylindrical shell 11 (FIG. 2) or be disposed at right angles to the axis of the cylindrical shell 11 to provide a radial outlet for bulk material to be withdrawn from the container 10 (FIG. 3).

Disposed within the shell 11 is a follower 30 for cleaning the inner surface 31 of the shell 11 as bulk material M is being withdrawn from the container 10 and to apply a force to the bulk material M for the removal of the bulk material M through the conduit 22. In the preferred embodiment, the follower 30 is a flexible follower.

The flexible follower 30 comprises an annular diaphragm 32 made from a suitable fabric, such as neoprene coated nylon fabric. The diaphragm 32 is disposed coextensive with the transverse cross-section of the shell 11. The fabric for the diaphragm 32, in the preferred embodiment, is a liquid impervious material, which is flexible and is relatively thin and cloth-like. Neoprene coated material, such as canvas, is suitable for these purposes. By employing a flexible follower, the follower can be folded to a collapsed form for removal from or entry into the shell 11 through the access opening 13 and can be expanded in the shell 11 to perform its intended functions. The diameter of the outermost wall 32*a* of the diaphragm 32 is dimensioned so as to engage the inner surface 31 of the shell 11. Disposed along the outermost wall 32*a* of the diaphragm 32 and contained within the diaphragm 32 is annular sponge 33 (FIG. 7). While the exemplary embodiment makes reference to a sponge, it is apparent that other suitable wiping material may be employed equally as well. The sponge 33 and the outermost wall 32*a* form a wiper for cleaning the inner surface 31 of the shell 11 as bulk material M is withdrawn from the container 10. Adjacent to the sponge 33 at the inboard side thereof is a stiffener, such as a tubular plastic ring 34, which serves to rigidify the circumferential portion of the diaphragm 32. An annular sleeve 35 made of suitable material, such as canvas, is fixed to the diaphragm 32 at the top and bottom of the annular sponge 33 to retain the tubular plastic ring 34 in a fixed position relative to the diaphragm 32.

The sponge 33 is flexible and foldable so as to be contracted for removal and insertion from and into the shell 11 through the access opening 13. The sponge 33 is expanded in the shell 11 for the cleaning of the inner surface 31 of the shell 11. The plastic ring 34 may be split for compression to facilitate its removal from and insertion into the shell 11 through the access opening 13. When expanded in the annular sleeve 35 within the shell 11, the ring 34 is suitable to provide a stiffener for the circumferential rim of the diaphragm 32.

Inboard of the sleeve 35 and disposed within the diaphragm 32 adjacent to the sleeve 35 is a suitable outer ring 36 (FIGS. 4 and 7) made of suitable metallic material. The outer flat ring 36 is split for removal of and insertion into the container 10 and for assembling in the diaphragm 32. After the outer ring 36 is inserted into the shell 11 and assembled in the diaphragm 32, the adjacent ends thereof at the split are secured together through a connecting plate fixed at one end and having an opening at the other end of the connected plate to receive a threaded stud fixed at the adjacent end of the outer ring 36. A wing nut is threaded to the stud to form a unitary structure for the outer ring 36. Thus, the outer ring 36 can be removed from and inserted into the shell 11 through the access opening 13 of the container 10. When reinserted into the diaphragm 32, the outer ring 36 is fully extended.

The tubular plastic member 34 is initially split and it is inserted in the canvas sleeve 35 after being inserted into the shell 11. Slits are formed in the sleeve 35 and in the hem of the body 32 at convenient intervals. After the tubular plastic member 34 is fully inserted into the sleeve 35, the adjacent ends of the tubular plastic member 34 at the slit are connected by a slip joint to form a unitary structure for the tubular plastic ring 34.

Formed at the center of the diaphragm 32 is a cylindrical opening 40, which passes through the diaphragm 32 in the axial direction thereof. The axis of the opening 40 is coextensive with the axis of the shell 11 and the axis of the access opening 13. Surrounding the opening 40 is an annular member or collar 41 made of suitable metallic material that is disposed in the annular diaphragm 32. Radial members 42 (FIGS. 1 and 4) of suitable metallic material are disposed in the diaphragm 32 and extend from the collar 41 to the outer ring 36. The collar 41, the radial members 42 and the outer ring 36 are secured together as an assembled unitary structure and serve to strengthen and rigidify the diaphragm 32. During the filling of the container 10 with material below the flexible follower 30, the collar 41, the radial members 42 and the outer ring 36 rigidify the diaphragm 32 to cause it to maintain a flatter shape rather than allow the diaphragm 32 to be unduly yieldable in the axial direction. This provides greater material fill space within the container 10.

A suitable drawstring 43 (FIG. 4) enables the fabric of the diaphragm 32 along the rim thereof to be drawn taut. An annular sleeve 49 formed in the diaphragm 32 contains the drawstring 43. The collar 41 and the radial members 42 are separable from the outer ring 36 so as to be removable from and insertable into the shell 11 through the access opening 13. The collar 41 and the radial members 42 are reassembled with the outer ring 36 while in the shell 11.

Thus, the flexible follower 30 can be dissembled to be removed from and inserted into the shell 11 through the access opening 13. While in the shell 11, the flexible follower 30 is reassembled and reinstalled.

To fill the container 10 with bulk material through the access opening 13 at the top wall 12 of the shell 11 and through the annular opening 40 of the flexible follower 30, a suitable fill tube 50 (FIGS. 1 and 2) has its lower end fixed to the diaphragm 32 below the inner ring 41. In the exemplary embodiment, the lower end of the fill tube 50 is sewn to the diaphragm 32. The fill tube 50 extends from the flexible follower 30 upwardly toward the access opening 13 of the container 10. At the upper end thereof, the fill tube 50 communicates with a conduit connected to a source or supply of bulk material for filling the container 10 below the flexible follower 30. The material filling the container 10 has passage through the access opening 13. When the container 10 is being filled, the flexible follower 30, in the preferred embodiment, is held at the upper portion of the container 10 (FIG. 1).

Connected to the inner ring 41 adjacent to and outward of the tube 50 and suspended from hooks 52 (FIG. 2) mounted on the top wall 12 of the shell 11 are a plurality of chains 55 spaced equal angular distances apart. In the exemplary embodiment, there are three chains 55 which are welded to the inner ring 41 at the lower end thereof. The chains 55 serve to lift the flexible follower 30 to the upper section of the container 10. Mounted on the bottom wall 20 of the shell 11 above the outlet opening 21 is a suitable guard 56 that prevents the flexible follower 30 from blocking the outlet opening 21. The guard 56 is in the form of an arcuate strap.

Initially, the flexible follower 30, in the preferred embodiment, is pulled up to the upper portion of the cylinder 10 through lifting the chains 55 manually (FIG. 2). When the flexible follower 30 is raised into the upper portion of the container 10, the chains 55 are secured to the hooks 52 to retain the flexible follower 30 in the raised position. Now, the fill tube 50 is connected to a conduit communicating with the supply or source of fill material. After the container 10 is filled with bulk material, all of which is stored below the flexible follower 30, the fill tube 50 is disconnected from the source or supply of bulk material. The fill tube 50 is sealed off adjacent the collar 41 by folding or pinching the tube 50 with the clamp 51 (FIG. 6). In the alternative, a valve, not shown, can be installed in the fill tube 50 for the opening and closing thereof at the collar 41. The closing of the fill tube 50 prevents bulk material from accumulating on the top of the flexible follower 30 and maintains cleanliness within the container 10.

For removing bulk material from the container 10 (FIG. 2), a cap sealing the conduit 22 is removed. Optionally, the pump 25 is connected to the conduit 22 to draw bulk material from the container 10. The chains 55 have been released from the hooks 52 to enable the flexible follower 30 to seat on the top surface of the bulk material M contained within the shell 11. The fill tube 50 has been sealed off or closed in the manner above described adjacent to the collar 41 by the clamp 51 and is movable with the flexible follower 30. As bulk material is drawn through the outlet 21 of the bottom wall 20 of the shell 11, the flexible follower 30 moves downwardly in the shell 11 in constant engagement with the upper surface of the bulk material. In so doing, the flexible follower 30 wipes the interior surface 31 of the shell 11 and applies a force on the bulk material to urge the bulk material into the outlet opening 21 to be withdrawn through the conduit 22. The force applied to the upper surface of the bulk material by the flexible follower 30 may be enhanced, if desired, by the application of a gas or liquid pressure to the upper side of the diaphragm 32. As the flexible follower 30 travels downwardly within the shell 11, the fill tube 50 will travel downwardly therewith.

Illustrated in FIG. 5 is a bulk material container 100 which is a modification of the bulk material container 10. The bulk material container 100 comprises a rigid shell 101 made of suitable material, such as mild steel, aluminum or stainless steel. Formed in a top wall 102 of the shell 101 is a suitable inlet and outlet access opening 103. Surrounding the access opening 103 is a suitable flange or lid receiving lip 104. A conventional cover 105 is detachably secured to the flange 104 for sealing the container 100.

Disposed within the shell 101 is a follower 110. The follower 110 is similar to the flexible follower 30 described in detail in connection with the bulk material container 10. Therefore, like parts will be designated by the same reference numeral but with a prime suffix added thereto.

Fixed to the diaphragm 32 of the flexible follower 110 in a manner previously described for the fill tube 50 is the lower end of a flexible or yieldable fill tube 115 that extends upwardly toward the flange 104 and communicates with a source or supply of bulk material to fill the shell 101 below the flexible follower 110. The material filling the container 100 has passage through the access opening 103. Removably disposed within the flexible tube 115 for removing material from the container 100 is a rigid draw-off or dip tube 120. The dip tube 120 extends almost to a bottom wall 121' of the shell 101 for removing material therefrom. At the upper section of the shell 101, the dip tube 120 is sealed to the flexible fill tube 115 through a suitable ring clamp 121, when the dip tube 120 is employed for withdrawing material from the container 10. The ring clamp 121 includes a band or collar that surrounds the upper end of the fill tube 115, which in turn encircles the dip tube 120. The band of the ring clamp 121 is separable and when urged to a closed position by a suitable pivotal latch that draws the separable ends together, the ring clamp 121 seals the upper end of the fill tube 115 between the ring clamp 121 and the dip tube 120. More specifically, the latch is a conventional over center snap latch. Communicating with the dip tube 120 is a suitable pump for drawing bulk material from the bottom of the container 101 through the dip tube 120 and out of the container 100 passing through the access opening 103.

Initially, the flexible follower 110, in the preferred embodiment, is pulled up to the upper portion of the shell 101 through the lifting of the chains 55' manually. The fill tube 115 is now sealed to the dip tube 120 by the clamp 121. When the flexible follower 110 is raised into the upper portion of the shell 101, the chains 55' are secured to the hooks 52' to retain the flexible follower 110 in the raised position. Now, the fill tube 115 is compressed and the fill tube 115 is connected to a conduit communicating with the supply or sources of fill material for the passage of bulk material through the access opening 103. The material filling the container 100 is discharged into the container 100 below the follower 110. After the container 100 is filled with bulk material, all of which is stored below the flexible follower 110, the fill tube 115 is disconnected from the source or supply of bulk material. The fill tube 115 is then sealed to the dip tube 120 by the clamp 121 in the manner above described.

For withdrawing bulk material from the container 100, the dip tube 120 is disposed in the fill tube 115 and the bottom of the dip tube 120 is disposed in the vicinity of the bottom wall 121 of the shell 101. When the dip tube 120 seats on the bottom wall 121 of the shell 101, it is formed with side suction ports. The fill tube 115 is sealed to the dip tube 120 through the ring clamp 121 at the top thereof. A pump is connected to the dip tube 120 for withdrawing bulk material from the container 110 by passage through the access opening 103. As bulk material is drawn through the dip tube 120, the flexible follower 110 moves downwardly in the container 100 in constant engagement with the upper surface of the bulk material. In so doing, the flexible follower 110 wipes the interior upright surface of the shell 101 and applies a force on the bulk material to urge the bulk material toward the bottom wall 121' of the shell 101. As the flexible follower 110 travels downwardly, the flexible tube 115 is extended and the lower end of the flexible tube 115 travels downwardly with the follower 110.

The dip tube 120 can also be employed to fill the container 100 with bulk material. Toward this end, the fill tube 115 is opened at the top thereof. The flexible follower 110 is pulled up to the upper portion of the container 100 through the lifting of the chains 55' manually. When the flexible follower 110 is raised into the upper portion of the container 100, the chains 55' are secured to the hooks 52' to retain the flexible follower 110 in the raised position. At the upper end of the shell 101, the dip tube 120 is sealed to the flexible fill tube 115 through the ring clamp 121. Now, the dip tube 120 is connected to a conduit communicating with the supply or source of fill material for the passage of material through the access opening 103. The material filling the container 100 is discharged into the shell 101 below the follower 110.

Illustrated in FIG. 8 is a bulk material container 125 which is a modification of the bulk material container 100 shown in FIG. 5. The bulk material container 125 comprises a rigid shell 126 similar to the shell 101 shown in FIG. 5. Formed in a top wall 127 of the shell 126 is a suitable inlet and outlet access opening 128. Surrounding the access opening 128 is a suitable flange or lid receiving lid 129. A conventional cover 130 is detachably secured to the flange 129 for sealing the bulk material container 125.

Disposed within the shell 126 is a follower 130. The follower 130 is similar to the flexible follower 110 described in connection with the bulk material container 100 (FIG. 5) and described in detail in connection with the bulk material container 10, except that the follower 130 does not include either a flexible tube 115 or a flexible tube 50.

Disposed within the shell 126 is a rigid fill or draw-off dip tube 135, which is similar to the dip tube 120 shown in FIG. 5. Carried by a diaphragm 136 of the flexible follower 130 and surrounding an axial opening 137 in the diaphragm 136 is an annular packing gland 140. The annular packing gland 140 is fixed to the diaphragm 136 within a collar 141 and provides a seal at the central opening 137 of the diaphragm 136. The packing gland 140 surrounds the dip tube 135 and provides a sliding seal with the outer wall of the dip tube 135. Thus, the dip tube 135 is fixedly positioned, and the packing gland 140 provides a sliding seal therewith as the follower 130 is raised and lowered within the shell 126.

Illustrated in FIG. 9 is a bulk material container 150 which is another modification of the bulk material container 10 shown in FIGS. 1–4. The bulk material container 150 comprises a rigid shell 151, such as the rigid shell 11 shown in FIGS. 1 and 2. Formed in the top wall 152 of the shell 151 is a suitable inlet access opening 153. Surrounding the access opening 153 is a suitable flange or lid receiving lip 154. A conventional cover 155 is detachably secured to the flange 154 for sealing the bulk material container 150.

Disposed within the shell 151 is a follower 160. The follower 160 is similar to the flexible follower 30 described in detail in connection with the bulk material container 10. Fixed to a diaphragm 161 of the flexible follower 160 is the lower end of a flexible or yieldable fill tube 162 that extends upwardly toward the flange 154 and communicates with a source or supply of bulk material to fill the shell 151 below the flexible follower 160. The fill tube 162 is connected to the diaphragm 161 in the manner described for the fill tube 50 and functions in the manner described for the fill tube 50 of the bulk material container 10.

The bulk material container 150 does not include any chains, such as chains 55 of the bulk material container 10, to lift and hold the flexible follower 160 in a raised position during the filling of the shell 151 with bulk material. Liquid pressure from liquid discharged through the flexible tube 162 below the flexible follower 160 will serve to lift the flexible follower 160 as the shell 151 is being filled with bulk material. As liquid is removed from the shell 151, the flexible follower 160 is drawn down. The tube 162 is sealed or pinched closed in the manner above described for the tube 50 during unloading. The flexible follower 160 is in constant contact with the surface of the liquid in the shell 151 during the removal of liquid therefrom and during a static condition. Air or gas enters above the flexible follower 160 during unloading.

Illustrated in FIG. 10 is a bulk material container 175 which is a modification of the bulk material container 150 shown in FIG. 9. The bulk material container 175 comprises a rigid shell 176, such as the rigid shell 11 shown in FIGS. 1 and 2. Formed in the top wall 177 of the shell 176 is a suitable inlet access opening 177'. Surrounding the access opening 177' is a suitable flange or lid receiving lip 178. A conventional cover 179 is detachably secured to the flange 178 for sealing the bulk material container 175.

Disposed within the shell 176 is a follower 180. The follower 180 is similar to the flexible follower 160 described in connection with the bulk material container 150. Sealed and fixed to a diaphragm 181 of the flexible follower 180 is the lower end of a flexible or yieldable fill tube 185 that extends upwardly toward the flange 178 and communicates with a source or supply of bulk material to fill the shell 176 below the flexible follower 180. The fill tube 185 is connected to the diaphragm 181 in the manner described for the fill tube 50 of the bulk material container 10.

For lifting the flexible follower 180 in a raised position during the filling of the shell 176 with bulk material, liquid pressure from liquid discharged through the flexible tube 185 below the flexible follower 180 will serve to lift the flexible follower 180 as the shell 176 is being filled with bulk material. As liquid is removed from the shell 176, the flexible follower 180 is drawn down. The tube 185 is sealed or pinched closed in the manner above described for the tube 50 and the tube 162 during unloading. The flexible follower 180 is in constant contact with the surface of the liquid in the shell 176 during the filling thereof with liquid, during the removal of liquid therefrom and during a static condition. Air or gas enters above the flexible follower 180 during the unloading.

Sealed to the inner upright wall 190 of the shell 176 entirely therearound and sealed to the outer rim 191 of the diaphragm 181 entirely therearound is a suitable plastic sheet 195, such as a polyethylene sheet. The plastic sheet 195 provides a flexible liner in the shell 176 for facilitating the cleanliness of the inside surface of the shell 176 above the flexible follower 180. A liner, such as plastic sheet 195, is particularly desirable when the shell, such as shell 176, has a rectangular or square cross-sectional area. The attachment of the sheet 195 to the surface 190 of the shell 176 is above the path of travel of the flexible follower 180 so as not to interfere with the upward travel thereof. In the alternative, the sheet 195 may be attached about the flange or lid receiving lip 178.

I claim:

1. A container for bulk material comprising:

(a) a shell formed with an inner surface and formed with an access opening at the top section thereof;

(b) a follower disposed within said shell and dimensioned to engage the inner surface of said shell for wiping the inner surface of said shell as bulk material is removed from said shell, said follower being in constant engagement with the upper surface of bulk material being removed from said shell, said follower being formed with an opening therethrough communicating with the portion of said shell therebelow, said opening being defined by a wall of said follower surrounding said opening;

(c) a flexible tube fixed at the lower section thereof to said wall surrounding said opening of said follower and extending upwardly toward said access opening to communicate with a supply of bulk material for filling said container with bulk material below said follower by having passage through said access opening of said shell; and (d) a rigid tube disposable within said flexible tube, said rigid tube having the lower end thereof terminating at the bottom section of said shell and arranged to withdraw bulk material from said shell by passage through said access opening formed in said shell.

2. A container as claimed in claim 1 wherein the upper portion of said flexible tube is removably secured to said rigid tube.

3. A container as claimed in claim 2 wherein said follower is movable in constant engagement with the upper surface of the bulk material as the bulk material is being removed from said shell through said rigid tube.

4. A container as claimed in claim 3 and comprising means attached to said follower and said shell for manually raising said follower to the top section of said shell during the filling of said shell with bulk material, said means being released during the removal of bulk material from said shell to enable said follower to remain in constant engagement with the upper surface of the bulk material as the bulk material is being removed from said shell through said rigid tube.

5. A container as claimed in claim 3 wherein said wall surrounding said opening of said follower is an annular member, said follower comprising radial arms extending from said annular member.

6. A container as claimed in claim 5 wherein said follower comprises an outer ring disposed concentric to said annular member and in contact with said radial arms extending from said annular member.

7. A container as claimed in claim 6 wherein said follower comprises a sleeve disposed adjacent to the outer cylindrical wall of said follower, and a stiffener ring disposed in said sleeve concentric with said annular member and said outer ring to form a cylindrical rim for said follower.

8. A container for bulk material comprising:

(a) a shell formed with an inner surface and formed with an access opening at the top section thereof;

(b) a follower disposed within said shell and dimensioned to engage the inner surface of said shell for wiping the inner surface of said shell as bulk material is removed from said shell, said follower being in constant engagement with the upper surface of bulk material being removed from said shell, said follower being formed with an opening therethrough communicating with the portion of said shell therebelow, said opening being defined by a wall of said follower surrounding said opening;

(c) a tube fixed at the lower section thereof to said wall surrounding said opening of said follower and extending upwardly toward said access opening to communicate with a supply of bulk material for filling said container with bulk material below said follower by having passage through said access opening of said shell; and (d) a flexible sheet sealed to said inner surface of said shell entirely therearound at the upper portion thereof outwardly of said access opening and sealed to said follower entirely therearound.

9. A container as claimed in claim 8 wherein said follower is a flexible follower.

10. A container as claimed in claim 8 wherein said flexible sheet is sealed to said follower adjacent the portion thereof wiping the inner surface of said shell.

11. A container as claimed in claim 10 wherein said flexible sheet is a plastic sheet.

12. A container as claimed in claim 10 wherein said wall surrounding said opening of said follower is an annular member, said follower having radial arms extending from said annular member.

13. A container as claimed in claim 13 wherein said follower comprises an outer ring disposed concentric to said annular member and in contact with said radial arms extending from said annular member.

14. In a container of the type that includes a lower discharge opening and a follower disposed inside the container and arranged for movement downwardly in the container in contact with the side walls thereof to maintain a downward pressure on the material being discharged, the improvement which comprises a filling tube extending downwardly through the follower, and a withdrawal tube within said filling tube and extending to a point below said follower.

15. The container of claim 14 wherein said follower includes a flexible diaphragm and said filler tube is secured to said diaphragm.

* * * * *